US008359876B2

(12) United States Patent
Esformes

(10) Patent No.: US 8,359,876 B2
(45) Date of Patent: Jan. 29, 2013

(54) REFRIGERATED DISPLAY MERCHANDISER WITH MICROCHANNEL EVAPORATOR ORIENTED TO RELIABLY REMOVE CONDENSATE

(75) Inventor: Jack L. Esformes, Jamesville, NY (US)

(73) Assignee: Carrier Corporation, Farmington, CT (US)

( * ) Notice: Subject to any disclaimer, the term of this patent is extended or adjusted under 35 U.S.C. 154(b) by 706 days.

(21) Appl. No.: 12/373,799

(22) PCT Filed: Jul. 28, 2006

(86) PCT No.: PCT/US2006/029757

§ 371 (c)(1),
(2), (4) Date: Nov. 23, 2009

(87) PCT Pub. No.: WO2008/013546

PCT Pub. Date: Jan. 31, 2008

(65) Prior Publication Data

US 2010/0064712 A1 Mar. 18, 2010

(51) Int. Cl.
*A47F 3/04* (2006.01)

(52) U.S. Cl. ..... 62/255; 62/515

(58) Field of Classification Search ..... 62/255, 62/246, 515; 165/181, 182
See application file for complete search history.

(56) References Cited

U.S. PATENT DOCUMENTS

| | | | | |
|---|---|---|---|---|
| 2,715,321 | A | 8/1955 | Burger | |
| 3,561,230 | A | 2/1971 | Gatton et al. | |
| 4,350,025 | A * | 9/1982 | Izumi | 62/285 |
| 4,621,685 | A * | 11/1986 | Nozawa | 165/111 |
| D304,855 | S * | 11/1989 | Aoki | D23/386 |
| 4,926,932 | A * | 5/1990 | Ohara et al. | 165/111 |
| 4,982,579 | A * | 1/1991 | Suzuki et al. | 62/515 |
| 5,341,870 | A | 8/1994 | Hughes et al. | |
| 5,765,393 | A | 6/1998 | Shlak et al. | |
| 6,216,773 | B1 * | 4/2001 | Falta | 165/153 |
| 6,435,268 | B1 * | 8/2002 | Bhatti et al. | 165/111 |
| 6,722,149 | B1 | 4/2004 | Saroka et al. | |
| 6,912,864 | B2 | 7/2005 | Roche et al. | |
| 6,993,925 | B2 * | 2/2006 | Duffy | 62/249 |
| 7,024,877 | B2 | 4/2006 | Yap | |
| 7,062,932 | B2 * | 6/2006 | Downs | 62/255 |
| 7,162,882 | B2 * | 1/2007 | Alahyari et al. | 62/89 |
| 2001/0003248 | A1 | 6/2001 | Otto et al. | |
| 2003/0140638 | A1 | 7/2003 | Arshansky et al. | |
| 2005/0193755 | A1 * | 9/2005 | Duffy | 62/246 |

OTHER PUBLICATIONS

Extended European Search Report mailed Sep. 30, 2010 (5 pgs.).
International Search Report and Written Opinion of International Searching Authority mailed Jan. 8, 2007 (8 pgs.).
International Preliminary Report on Patentability mailed Mar. 12, 2009 (6 pgs.).

* cited by examiner

*Primary Examiner* — Mohammad Ali
(74) *Attorney, Agent, or Firm* — Cantor Colburn LLP

(57) ABSTRACT

A refrigerated display merchandiser is provided that includes a microchannel evaporator positioned within the merchandiser such that both the fins and the tubes of the microchannel evaporator are vertically oriented or substantially vertically oriented with respect to a vertical axis of the refrigerated display merchandiser, thus more reliably ensuring removal of condensate from the microchannel evaporator.

26 Claims, 5 Drawing Sheets

REFRIGERATED DISPLAY MERCHANDISER WITH MICROCHANNEL EVAPORATOR ORIENTED TO RELIABLY REMOVE CONDENSATE

FIELD OF THE INVENTION

This invention relates generally to refrigerated display merchandisers of the type used in commercial establishments to display refrigerated or frozen products. More particularly, this invention relates to a refrigerated display merchandiser including a microchannel evaporator that is oriented so as to more reliably ensure removal of condensate that accumulates on the surfaces of the tubes and fins of the microchannel evaporator.

BACKGROUND OF THE INVENTION

Refrigerated display merchandisers (also referred to as display cases) are used to contemporaneously refrigerate and display products in commercial settings such as supermarkets, mini-marts and convenience stores. There are two general categories of display cases: those with an open front display and those with a closed front display. Open front type display cases are advantageous in that unlike closed front type cases they do not have containment doors, and thus they allow for unobstructed display of products and enable consumers to handle products without the inconvenience that occurs when it is necessary to open a door to access products in a closed type case. However, both types of display cases are used today and will likely continued to be used for the foreseeable future.

Although the specific design and arrangement of open and closed front display cases can vary, current models include a heat exchanger (e.g., an evaporator), which serves an important role in maintaining a product display region at a proper temperature to prevent spoilage of displayed products. The evaporator operates in a cycle during which air is circulated over the evaporator, cooled by refrigerant within the evaporator, and then directed to the product display region of the display case so as to cool the products therein. At least a portion of the cooled air also forms an air curtain in the front of the display case and thus acts as a barrier to inhibit warm air from entering the product display region. Some of the air from the air curtain is merged with air from the product display region and is drawn back into the evaporator, thus restarting the air cooling cycle anew.

A wide variety of evaporator designs are incorporated or are possible for application in refrigerated display merchandisers. Among these are so-called microchannel evaporators (also often designated by the abbreviation "MCHX"), which refer to a particular type of heat exchanger that includes substantially parallel flat tubes with fins disposed between and connected to the tubes. Of late, microchannel evaporators are receiving an increasing amount of attention from the Heating Ventilating Air Conditioning and Refrigeration (HVACR) industry due to their oftentimes superior performance in certain settings (e.g., in refrigerated display merchandisers) as compared to evaporators that have different designs, such as round tube plate fin evaporators.

During operation of a microchannel evaporator, moisture in the air that enters and exits the microchannel evaporator will condense on the surfaces of the tubes and fins when their surface temperature is at or below the dewpoint of the air. Thus, when the microchannel evaporator is maintained at a freezing temperature, moisture will condense on the surfaces of the tubes and fins as frost, which, if not removed, can cause problems such as increased product temperature and decreased efficiency of the microchannel evaporator. If, instead, the microchannel evaporator is operated at an above-freezing temperature, then moisture will condense on the surfaces of the tubes and fins as water, which, if not adequately drained, will disadvantageously impede the flow of air through the microchannel evaporator.

Various options exist for removing the frost from (i.e., for defrosting) a microchannel evaporator. If the microchannel evaporator utilizes a medium temperature (e.g., about 15° to about 30° F.) refrigerant, then the flow of refrigerant to the microchannel evaporator can be halted temporarily (e.g., for about 20 to 30 minutes) at predetermined intervals (e.g., 4 to 6 times within a 24 hour period) while one or more air circulation devices (e.g., fans) present within the display case continue to operate. If, however, the microchannel evaporator uses a low temperature refrigerant (e.g., about −5° F. to about −40° F.), then halting the flow of refrigerant alone is not sufficient to melt the frost. Instead, the microchannel evaporator can be equipped with a heater, and/or hot gas from the compressor can be introduced into the microchannel evaporator to melt the accumulated frost.

Although these techniques successfully cause the frost on a microchannel evaporator to thaw and melt (i.e., to defrost) without also causing the temperature of the display case and its contents to rise to an unacceptable level, a problem arises in that a portion of the melted frost condensate is retained on the surfaces of the tubes and fins of the microchannel evaporator and refreezes once refrigerant flow resumes. This problem is particularly troublesome since any frozen condensate that remains following defrosting will disadvantageously impede the flow of air through the microchannel evaporator during a cooling cycle. Although this problem could be addressed through longer and/or more frequent defrost periods, that, in turn, would increase the temperature of the display case and its contents to unacceptable levels during the defrost cycle(s).

Some in the art have attempted to solve this problem by orienting microchannel evaporators in a manner that purportedly promotes reliable removal of melted frost condensate from the surfaces of the tubes and fins of the microchannel evaporator, as well as continuous removal of condensate from the surfaces of the tubes and fins of the microchannel evaporator during non-freezing applications. Two such approaches are illustrated schematically in FIGS. 1-1C and FIGS. 2-2C.

FIG. 1 depicts a microchannel evaporator 10 that rests atop a horizontal surface 25 and includes a plurality of fins 20 connected to a plurality of tubes 30. As shown in FIG. 1A, the fins 20 (only one fin is shown for ease of viewing) of the microchannel evaporator 10 are disposed in a vertical plane with respect to a vertical axis 50 of the display case (not shown) in which the microchannel evaporator is present. Conversely, the tubes 30 to which the fins 20 are connected are disposed in a horizontal plane with respect to the vertical axis 50 of the display case. As illustrated by FIGS. 1B and 1C, and in an effort to promote removal of condensate from its fins 20 and tubes 30, the microchannel evaporator 10 can be oriented so as to be offset with respect to the vertical axis 50 of the display case by an angle, A, of up to 30° to the left (see FIG. 1B) or up to 30° the right (see FIG. 1C). That, in turn, renders the fins 20 substantially vertically disposed with respect to the vertical axis 50 of the display case, and the tubes 30 substantially horizontally disposed with respect to the vertical axis of the display case.

Referring again to FIG. 1A, arrows 70, 80 depict the flow path of condensate when present on fins 20 and tubes 30 that are oriented as depicted in FIGS. 1-1C, wherein arrows 70 depict the flow path of condensate on the fins 20 and arrows 80 depict the flow path of condensate on the tubes 30. As indicated by arrows 80, a horizontal orientation (see FIG. 1A) or a substantially horizontal orientation (see FIGS. 1B and 1C) of the tubes 30 with respect to the vertical axis 50 of the display case will cause at least a portion of the condensate to pool on the surfaces of the tubes 30 and between adjacent fins 20 rather than be removed therefrom. This is problematic because the pooled condensate will tend to refreeze and cause the above-noted air flow problems if the microchannel evaporator 10 of FIGS. 1-1C is being used in a medium or low temperature freezing application. Also as explained above, the pooled condensate can cause air flow problems even if, instead, the microchannel evaporator 10 of FIGS. 1-1C is being used in an above-freezing application.

FIGS. 2-2C illustrate an alternative orientation for a microchannel evaporator 10' in which the microchannel evaporator 10' also rests atop a horizontal surface 25 and includes a plurality of fins 20 connected to a plurality of tubes 30. In this instance, however, and as best shown by the more detailed view of FIG. 2A, the tubes 30 of the microchannel evaporator 10' are disposed in a vertical plane with respect to the vertical axis 50 of the display case (not shown) in which the microchannel evaporator 10' is disposed, whereas the fins 20 (only one fin is shown for ease of viewing) of the microchannel evaporator 10' are disposed in a horizontal plane with respect to the vertical axis 50 of the display case.

As illustrated by FIGS. 2B and 2C, and also in an effort to promote removal of condensate from its fins 20 and tubes 30, the microchannel evaporator 10' can be oriented so as to be offset with respect to the vertical axis 50 of the display case by an angle, B, of up to 30° to the left (see FIG. 1B) or of up to 30° the right (see FIG. 1C). That, in turn, renders the fins 20 substantially horizontally disposed with respect to the vertical axis 50 of the display case, and the tubes 30 substantially horizontally disposed with respect to the vertical axis of the display case.

Referring again to FIG. 2A, arrows 70, 80 depict the flow path of condensate when present on fins 20 and tubes 30A, 30B that are oriented as shown in FIGS. 2-2C, wherein arrows 70 depict the flow path of condensate on the fins 20 and arrows 80 depict the flow path of condensate on the tubes 30. As indicated by arrows 70, 80, a horizontal (see FIG. 2A) or a substantially horizontal (see FIGS. 2B and 2C) orientation of the fins 20 with respect to the vertical axis of the display case will cause at least a portion of the condensate to pool on the surfaces of the fins rather than be removed therefrom. This is problematic because, just as was the case with the FIGS. 1-1C microchannel evaporator 10, the pooled condensate on the FIGS. 2-2C microchannel evaporator 10' can cause the above-noted air flow problems if the microchannel evaporator 10' of FIGS. 2-2C is being used in an above-freezing application, or in a low or medium temperature freezing application.

Further, due to the orientation of the fins 20 and tubes 30 of the FIGS. 2-2C microchannel evaporator 10 ° with respect to the vertical axis 50 of the display case, it becomes necessary to deliver refrigerant to the microchannel evaporator 10' via an inlet header (not shown) that is generally longer than that which is used for the FIGS. 1-1C microchannel evaporator 10. In fact, in some instances, the inlet header that is used for a microchannel evaporator 10' oriented as shown in FIGS. 2-2C can be upwards of 10 feet in length. That alone can pose design and/or manufacturing difficulties, but perhaps more problematic is it necessitates that refrigerant travel multiple feet through the inlet header to reach the microchannel evaporator 10'. As such, there is a comparatively much greater risk of separation of the liquid and vapor components of the refrigerant within the inlet header than there would be if the inlet header was instead shorter as it would be for the FIGS. 1-1C microchannel evaporator 10. Moreover, if liquid/vapor separation was to occur, not all tubes 30 of the FIGS. 2-2C microchannel evaporator 10' would be guaranteed to receive refrigerant, and, consequently, the microchannel evaporator 10' of FIGS. 2-2C could produce comparatively warmer air than expected. This warmer air would not as fully cool the display case, which in turn, might not be able to function effectively, let alone optimally. This would present a problem whether or not the microchannel evaporator was being used in an above-freezing application, or in a low or medium temperature freezing application.

Therefore, a need presently exists for a refrigerated display merchandiser that includes a microchannel evaporator which can be oriented so as to effectively remove or cause to be removed condensate that accumulates on the surfaces of the tubes and fins of the microchannel evaporator during its operation, yet that also will not necessitate a lengthy refrigerant inlet header and will not otherwise interfere with the operation, functioning and/or design of either an open type or a closed type of refrigerated display merchandiser in which the microchannel evaporator is incorporated.

SUMMARY OF THE INVENTION

These and other needs are met by a refrigerated display merchandiser, which, according to one exemplary aspect, includes a vertical axis and comprises (a) a display zone that defines a product display region, (b) an air circulation zone that includes at least one air circulation device, and (c) a microchannel evaporator that is disposed within the air circulation zone. The microchannel evaporator comprises a plurality of tubes and a plurality of fins between at least some of the plurality of tubes, wherein the plurality of tubes and the plurality of fins are at least substantially vertically oriented with respect to the vertical axis of the refrigerated display merchandiser.

It is currently preferred for both the tubes and the fins of the microchannel evaporator to be in a plane that is at least substantially vertically oriented with respect to the vertical axis of a display case in which the microchannel evaporator is present, since such an orientation advantageously causes condensate to remove itself from the surfaces of the tubes and fins of the microchannel evaporator so as not to interfere with air flow into the microchannel evaporator in an above-freezing application, or in a low or medium temperature freezing application. Such an orientation also enables the flow of air into the microchannel evaporator to be at least substantially in the direction of gravity, thus further helping to cause condensate to remove itself from the surfaces of the tubes and fins of the microchannel evaporator.

In accordance with this or other exemplary aspects, the refrigerated display merchandiser can be open front type or closed front type. Also, the refrigerated display merchandiser can have a horizontal axis, wherein the microchannel evaporator can be offset from the horizontal axis of the refrigerated display merchandiser by an angle, which, for example, can be up to about 30° (e.g., between about 0° and about 15°).

Also, in accordance with this or other exemplary aspects, the microchannel evaporator can include a refrigerant inlet adapted to supply refrigerant of a predetermined temperature (e.g., above about 30° F. for above-freezing applications, between about 15° F. to about 30° F. for medium temperature freezing applications, or between about −5° F. to about −40° F. for low temperature freezing applications) to the microchannel evaporator. By way of non-limiting example, the refrigerant inlet can have a length less than about two feet, such as between about 10 inches to about 18 inches.

Further in accordance with this or other exemplary aspects, the density of fins (e.g., the number of fins per inch) of the microchannel evaporator can be in the range of 2 fins per inch and 14 fins per inch, and the depth and spacing of the tubes of the microchannel evaporator can be in the range of about 0.5 inch to about 2.5 inches and about 0.3 inch to about 0.8 inch, respectively.

Still further in accordance with this or other exemplary aspects, a predetermined quantity of air can be supplied to and cooled by the microchannel evaporator, wherein at least a portion of the cooled air is supplied to the display zone via the air circulation zone. And by way of non-limiting example, at least a portion of the air cooled by the microchannel evaporator can be supplied to the display zone via at least one opening defined between the display zone and air circulation zone.

In accordance with another exemplary aspect, the refrigerated display merchandiser includes a vertical axis and a rear wall that is substantially parallel to the vertical axis, wherein the rear wall has a top edge and a bottom edge. A top wall extends from the top edge of the rear wall and is normal to the vertical axis, and a base extends from the bottom edge of the rear wall and is normal to the vertical axis. A back panel is horizontally offset from the rear wall, wherein the back panel has a top edge and a bottom edge. A top panel extends from the top edge of the back panel and is vertically offset from the top wall, and an interior base panel extends from the bottom edge of the back panel and is vertically offset from the base. A display zone is defined between the top panel and the interior base panel and forward of the back panel, wherein the display zone includes a product display region. An air circulation zone includes at least one air circulation device, is substantially continuous, and is defined between the top wall and the top panel, between the rear wall and the back panel, and between the base and the interior base panel. A microchannel evaporator is disposed within the air circulation zone, wherein the microchannel evaporator comprises a plurality of tubes and a plurality of fins between at least some of the plurality of tubes, wherein the plurality of tubes and the plurality of fins are at least substantially vertically oriented with respect to the vertical axis of the refrigerated display merchandiser.

Still other aspects, embodiments and advantages of these exemplary aspects are discussed in detail below. Moreover, it is to be understood that both the foregoing general description and the following detailed description are merely illustrative examples of various embodiments, and are intended to provide an overview or framework for understanding the nature and character of the claimed embodiments. The accompanying drawings are included to provide a further understanding of the various embodiments, and are incorporated in and constitute a part of this specification. The drawings, together with the description, serve to explain the principles and operations of the described and claimed embodiments.

BRIEF DESCRIPTION OF THE DRAWINGS

For a fuller understanding of the nature and desired objects of the present invention, reference is made to the following detailed description taken in conjunction with the accompanying figures, wherein like reference characters denote corresponding parts throughout the views, and in which.

DETAILED DESCRIPTION

Figure 1:
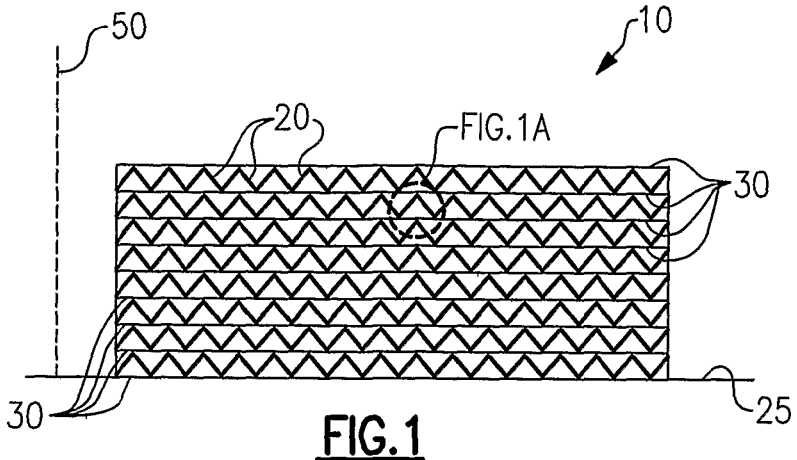
FIG.1 Prior Art
FIG. 1 is a schematic front view of a first conventional orientation for a microchannel evaporator of a refrigerated display merchandiser.
Figure 1A:
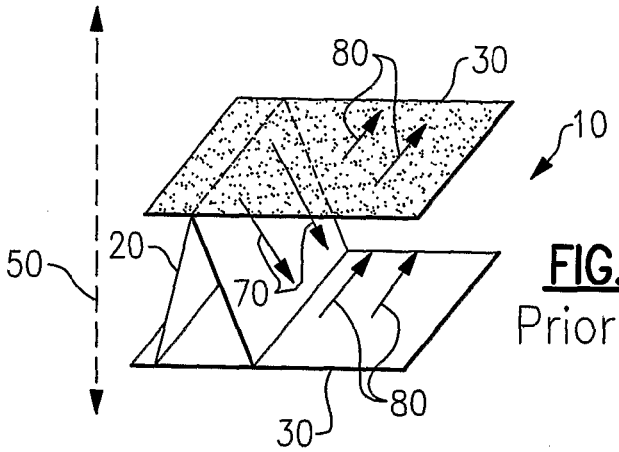
FIG.1A Prior Art
FIG. 1A is an enlarged, schematic front view of the encircled portion of the microchannel evaporator of FIG. 1 that is labeled 1A.
Figure 1B:
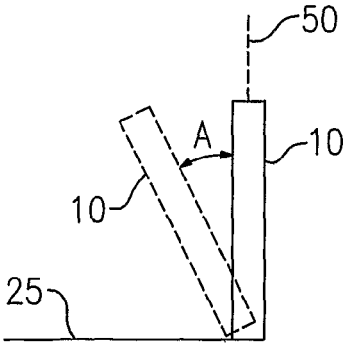
FIG.1B Prior Art
FIGS. 1B and 1C are schematic end views of two alternate orientations of the microchannel evaporator of FIG. 1.
Figure 1C:
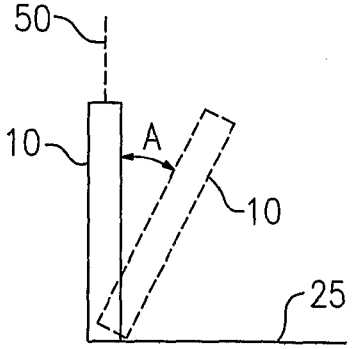
FIG.1C Prior Art
Figure 2:
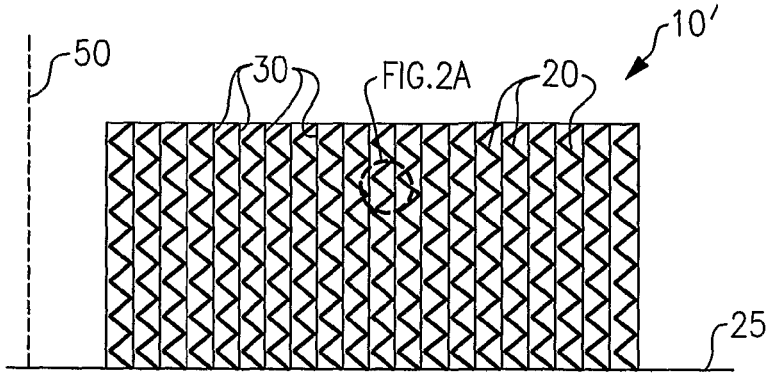
FIG.2 Prior Art
FIG. 2 is a schematic front view of a second conventional orientation for a microchannel evaporator of a refrigerated display merchandiser.
Figure 2A:
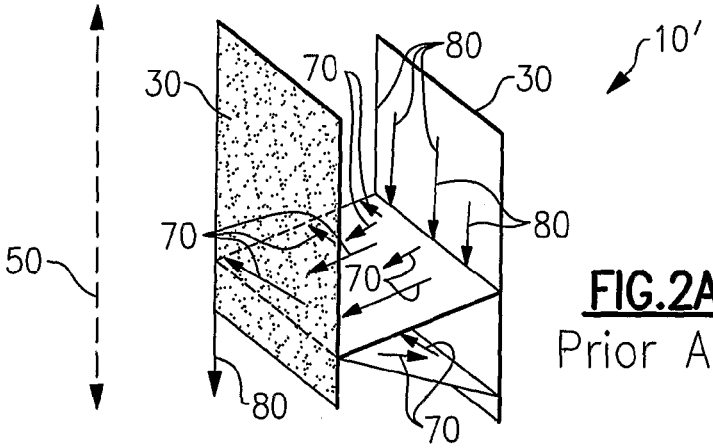
FIG.2A Prior Art
FIG. 2A is an enlarged, schematic front view of the encircled portion of the microchannel evaporator of FIG. 2 that is labeled 2A.
Figure 2B:
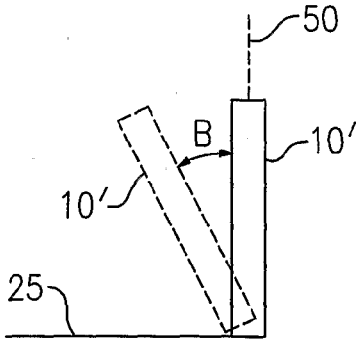
FIG.2B Prior Art
FIGS. 2B and 2C are schematic end views of two alternate orientations of the microchannel evaporator of FIG. 2.
Figure 2C:
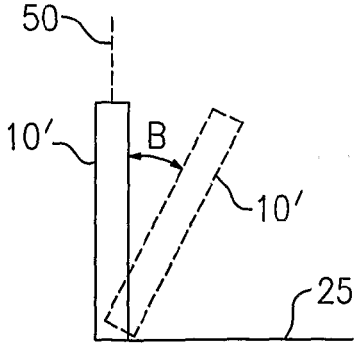
FIG.2C Prior Art
Figure 3:
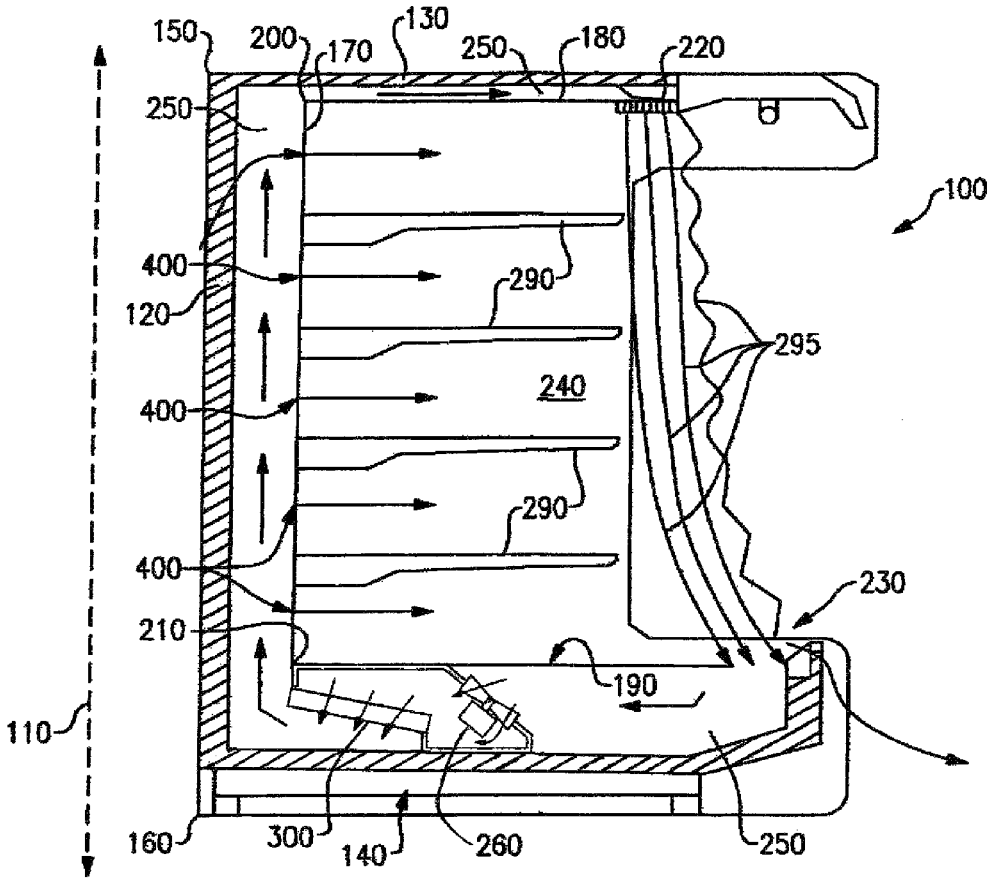
FIG. 3 is a side, schematic cross-sectional view of an exemplary embodiment of an open display type refrigerated display merchandiser.

Referring initially to FIG. 3, an exemplary refrigerated display merchandiser (i.e., display case) 100 is shown. It should be noted that the depicted display case 100 is an open front type display case; however, all of the various embodiments described herein are equally applicable to closed front type display cases. Moreover, the various embodiments described herein also are equally applicable to display cases that serve various refrigeration purposes and that utilize refrigerant having various temperatures. For example, the display case can be used for an "above-freezing" application (e.g., to cool products such as fresh produce) utilizing refrigerant above about 30° F., or for a "medium temperature freezing" application (e.g., to refrigerate perishable products such as meat and dairy products) utilizing refrigerant between about 15° F. and about 30° F., or for a "low temperature freezing" application (e.g., to maintain the frozen state of products such as ice cream and frozen foods) utilizing refrigerant between about −5° F. and about −40° F.

The exemplary display case 100 depicted in FIG. 3 includes a vertical axis 110 and a rear wall 120 that is substantially parallel to the vertical axis. A top wall 130 and a base 140 extend, respectively, from a top edge 150 and a bottom edge 160 of the real wall 120 and are substantially normal to the rear wall and thus also normal to the vertical axis 110 of the display case 100. The display case 100 also can include, and generally does include, one or two side walls (not shown), which also are substantially parallel to the vertical axis 110 of the display case 100 and generally extend from the top wall 130 to the base 140 at either or both sides of the display case.

The display case 100 further includes a back panel 170 that is substantially parallel to and horizontally offset from the real wall 120. A top panel 180 and an interior base panel 190 extend, respectively, from a top edge 200 and a bottom edge 210 of the back panel 170, wherein the top panel is substantially parallel to and vertically offset from the top wall 130, and wherein the interior base panel is substantially parallel to and vertically offset from the base 140. The top wall 130 is connected to the top panel 180 to define an air outlet 220 and the interior base panel is 190 connected to the base floor 140 to define an air inlet 230.

The area between the air inlet 230 and the air outlet 220 is defined as an air circulation zone 250, wherein one or more air circulation devices (e.g., one or more fans) 260 are disposed within the air circulation zone. The specific location of the one or more air circulation devices 260 can vary; however, generally, and as depicted in FIG. 3, there is at least one air circulation device 260 in proximity to the air inlet 230 so as to cause air to enter the air inlet as will be explained further below. The exemplary embodiment of FIG. 3 also can include one or more additional air circulation devices (not shown). By way of non-limiting example, a second air circulation device (not shown) can be located in proximity to the air outlet 220 so as to assist in causing air to exit the air outlet. The specific size and design of the one or more air circulation devices 260 can vary; however, when an air circulation device is a fan, it generally includes a motor shaft 265, a motor 270 and fan blades 280 (see FIG. 4).

Also present within the air circulation zone 250 is a heat exchanger device (e.g., an evaporator) 300. It is currently preferred for the evaporator 300 to be a microchannel evaporator, which generally is located within a portion of the air circulation zone 250 between the air circulation device 260 and air outlet 220, such as between the interior base panel 190 and the base floor 140 as shown in FIG. 3.

A product display region 240 is defined within the area between the top panel 180 and the interior base panel 190, and forward of the back panel 170. Generally, but not necessarily, one or more product display elements (e.g., one or more shelves) 290 are disposed within the product display region 240 and extend from the back panel 170 of the display case 100. The number and/or placement of the product display elements 270 can vary according to factors such as the size and shape of the display case 100, the products being displayed, etc.

The display case 100 can operate selectively or substantially continuously. During operation of the display case, the air circulation device 260 causes air to enter the air inlet 230 and to be circulated into the microchannel evaporator 300, at which the air is cooled to predetermined temperature by refrigerant within the evaporator. The cooled air exits the microchannel evaporator 300 and rises into the portion of the air circulation zone 250 located between the rear wall 120 and the back panel 170. Generally, the back panel 170 includes one or more openings or perforations 400 from which a predetermined portion of the cooled air exits the air circulation zone 250 and enters the product display region 240, thus cooling the product display region and the product(s) contained therein. The size, shape and total number of openings 400 can vary, but are generally chosen to ensure that at least a portion (but not all) of the cooled air enters the product display region 240.

The portion of the cooled air that does not enter the product display region 240 travels into and through the segment of the air circulation zone 250 that is located between the top wall 130 and the top panel 180. A second air circulation device, if present, can assist this air in being brought to and expelled from the air outlet 220. This expelled air forms what is generally referred to as an "air curtain" 295, which is expelled from the air outlet 220 so as to be directed toward the air inlet 230. Generally, the air curtain 295 also will be partially formed from air exiting the product display region 240.

Based on its position and temperature, and as shown in FIG. 3, the air curtain 295 acts as a barrier to warm, moisture laden ambient air that is attempting to enter the product display region 240. It should be noted that more than one air curtain 295 can be utilized, as described, e.g., in U.S. Pat. No. 6,722,149, the entirety of which is incorporated by reference herein. Due to the air curtain 295 being aimed toward the air inlet 230, and in view of the presence of the air circulation device 260, at least a portion of the air from the air curtain will be caused to re-enter the air inlet 230, thus enabling the air cooling process to start anew.

Figure 4:
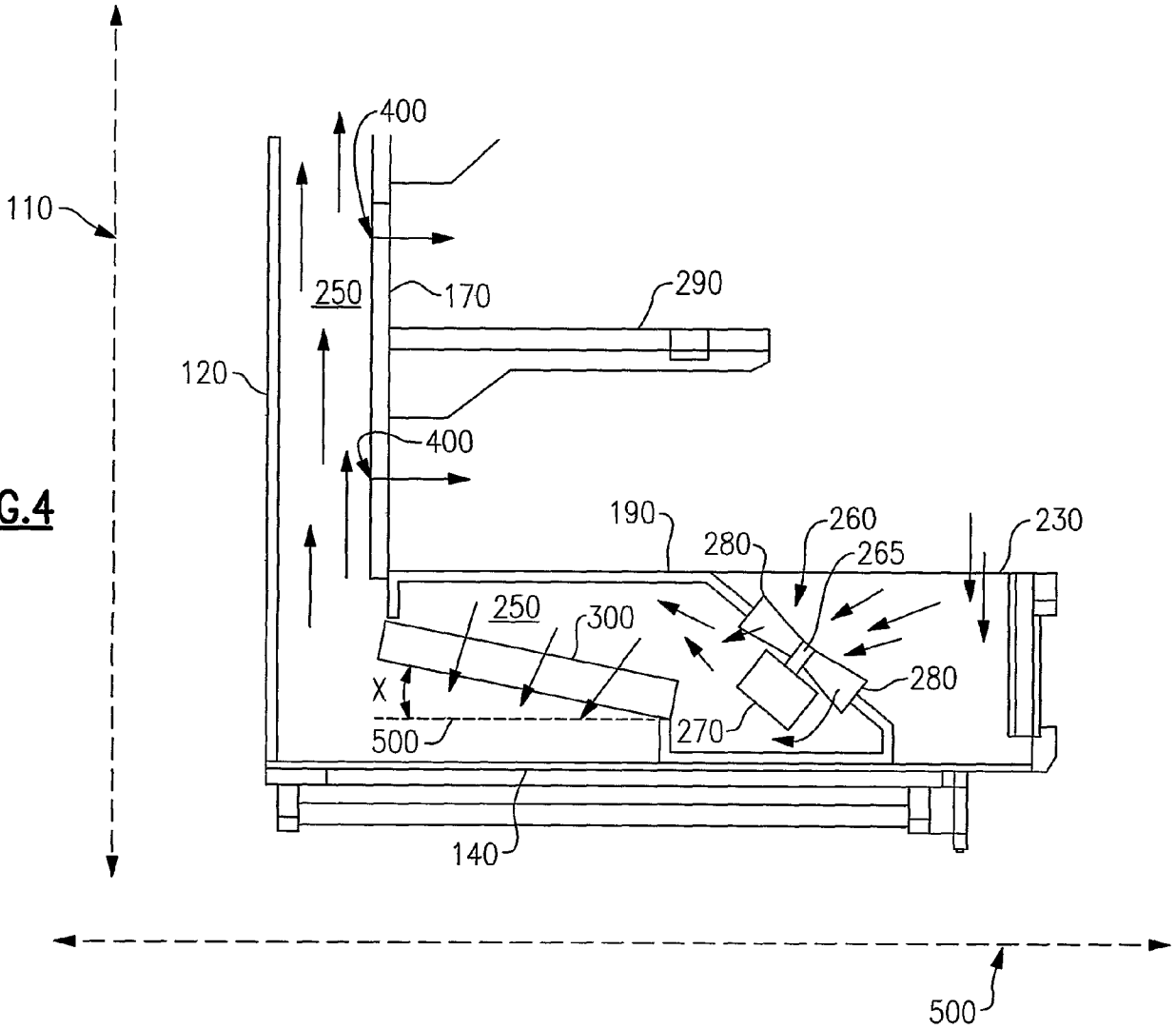
FIG. 4 is an enlarged schematic view of a lower portion of the refrigerated display merchandiser of FIG. 3.

Referring now to FIG. 4, a portion of the display case 100 is illustrated in magnified detail. In particular, the microchannel evaporator 300 is schematically depicted in an exemplary orientation that allows air to flow from the air circulation device 260 into the microchannel evaporator in a gravity-assisted or substantially gravity assisted direction. It is beneficial for the air flow direction to coincide with gravity as such, since that helps cause condensate to be removed from the surface of the microchannel evaporator 300.

Figure 5:
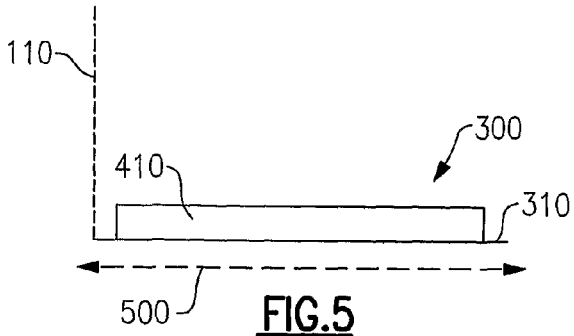
FIG. 5 is a schematic side view of an exemplary orientation for the microchannel evaporator of the refrigerated display merchandiser of FIGS. 3 and 4.
Figure 5A:
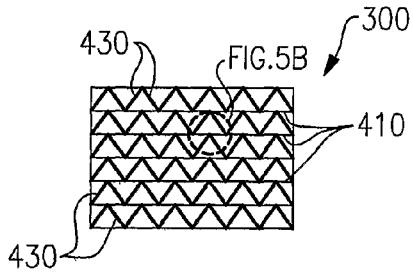
FIG. 5A is a schematic top view of the microchannel evaporator of FIG. 5.
Figure 5B:
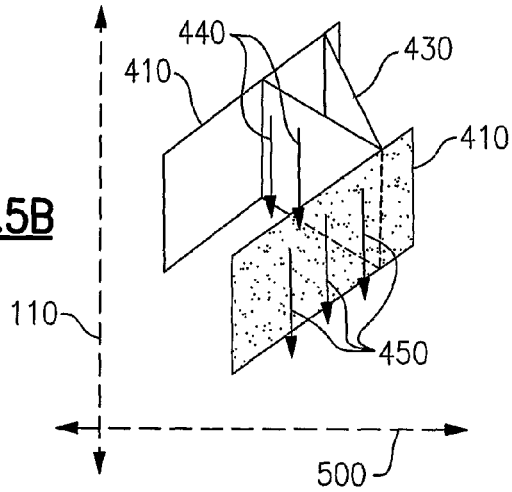
FIG. 5B is an enlarged, schematic top view of the encircled portion of the microchannel evaporator of FIG. 5A that is labeled 5B.
Figure 5C:
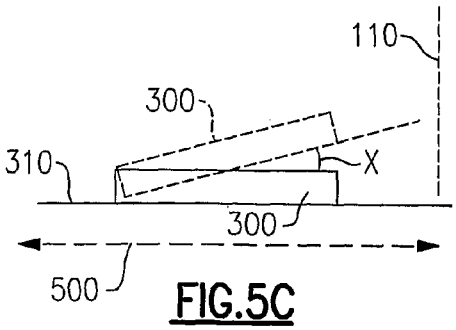
FIGS. 5C and 5D are schematic end views of two alternate orientations of the microchannel evaporator of FIG. 1
Figure 5D:
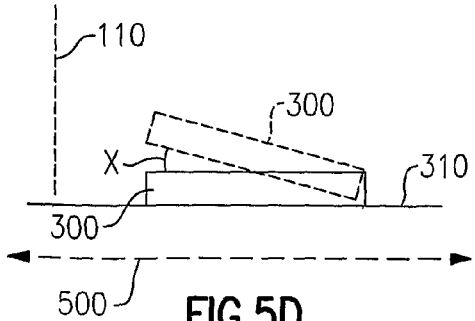

As shown in FIG. 5B, the microchannel evaporator 300 can be positioned in a plane that is parallel to a horizontal axis 500, which is normal to the vertical axis 110 of the display case. Alternatively, and as shown in FIGS. 4, 5C and 5D, the microchannel evaporator 300 can be offset from the horizontal axis 500 by a predetermined angle, X, of up to about 30°, wherein a currently preferred angle of offset is in the range of about 0° to about 15°. This orientation in a plane that is parallel (see FIG. 5B) or substantially parallel (see FIGS. 4, 5C and 5D) with respect to the horizontal axis 500 also can help cause condensate to remove itself from the microchannel evaporator 300, as explained further below.

Referring now to FIGS. 5-5D, the microchannel evaporator 300 is schematically shown in still greater detail. The microchannel evaporator 300 rests atop a horizontal surface 310 and, as best shown in FIG. 5A, includes a plurality of fins 430 (only one fin 430 is shown in FIG. 5B for ease of viewing) disposed between and connected to a plurality of tubes 410 (e.g., via brazing).

The tubes 410 and fins 430 can have various sizes depending, e.g., on the size of the display case in which the evaporator 300 is incorporated. Generally, however, the fins 430 and tubes 410 have certain numerical characteristics, as noted in Table I below:

TABLE I

| | General range for all display cases, including those that are used in above-freezing applications | Currently preferred range when the microchannel evaporator is incorporated in display case that is utilized for a medium temperature freezing application | Currently preferred range when the microchannel evaporator is incorporated in display case that is utilized for a low temperature freezing application |
|---|---|---|---|
| Fin Density | 2 to 14 Fins per inch | 4 to 8 fins per inch | 2 to 6 fins per inch |
| Tube Depth | about .5 inch to about 2.5 inches | about 0.5 inch to about 2.5 inches | about 0.5 inch to about 2.5 inches |
| Tube Spacing | about 0.3 inch to about 0.8 inch | about 0.35 inch to about 0.7 inch | about 0.35 inch to about 0.7 inch |

By virtue of the position of the microchannel evaporator 300 within the display case 100, and as best shown in FIG. 5B, both its tubes 410 and its fins 430 are disposed in a vertical plane with respect to a vertical axis 110 of the display case (not shown) in which the microchannel evaporator is present. If the microchannel evaporator 300 is offset from its horizontal axis 500 (as depicted in FIGS. 4, 5C and 5D) by an angle, X, of up to 30° to the left (see FIG. 5C) or up to 30° the right (see FIGS. 4 and 5D), then the fins 20 and tubes 410 are disposed in a substantially vertical plane with respect to the vertical axis 110 of the display case.

The FIGS. 5-5D orientation of the microchannel evaporator 300 and its tubes 410 and fins 430 is in contrast to the orientation of conventional microchannel evaporators 10, 10', such as those illustrated in FIGS. 1-1C and 2-2C, wherein either the tubes 30 (see FIGS. 1-1C) or the fins 20 (see FIGS. 2-2C) of the microchannel evaporator are oriented horizontally or are oriented substantially horizontally with respect to a vertical axis 50 of the display case (not shown) in which the microchannel evaporator is disposed. In each of the FIGS. 5-5D orientations, the microchannel evaporator will enjoy the same advantages over the FIGS. 1-1C and 2-2C of the conventional evaporators 10, 10'.

In particular, because the tubes 410 and fins 430 of the microchannel evaporator 300 of FIGS. 5-5D are vertically or substantially vertically oriented with respect to the vertical axis 110 of the FIG. 3 display case 100, condensate reliably will be caused to be removed (i.e., by gravity) from the fins 430 in the path of arrows 440 and from the tubes 410 in the path of arrows 450, as best illustrated in FIG. 5B. That, in turn reliably prevents problems from occurring due to the presence of condensate on the surface of the evaporator. For example, it prevents melted frost condensate from disadvantageously refreezing if the evaporator is used in a low or medium temperature freezing application, but also it prevents moisture-produced condensate from impeding the flow of air into and from the evaporator when the evaporator is used in an above-freezing application. As such, the FIGS. 5-5D orientation of the microchannel evaporator 300 is advantageous as compared to the orientations of the FIG. 1 conventional microchannel evaporator 10 and the FIG. 2 conventional microchannel evaporator 10'.

Additionally, the FIGS. 5-5D orientation of the microchannel evaporator 300 enables an inlet header (not shown) that routes refrigerant from a refrigerant source (not shown) to the microchannel evaporator 300 to have a short length, usually no more than about 10 to about 18 inches. As such, the FIGS. 5-5C orientation of the microchannel evaporator 300 is even more advantageous as compared to the orientation of the FIGS. 2-2C conventional microchannel evaporator 10', which disadvantageously requires a much longer (e.g., upwards of 12 feet) inlet header.

Moreover, the FIGS. 5-5D orientation of the microchannel evaporator 300 also enables air to flow into the evaporator in a gravity-assisted or substantially gravity-assisted direction. This is beneficial whether the microchannel evaporator 300 is incorporated in an above-freezing application or a low or medium temperature freezing application; however, it is especially useful in instances when the microchannel evaporator 300 is used in an above-freezing application, since the fact that air flows into the evaporator in a gravity assisted or substantially gravity-assisted direction makes it less likely that condensate will accumulate on the surface of the microchannel evaporator, and thus less likely that the flow of the air into the evaporator will be disadvantageously impeded.

Although various embodiments have been described herein, it is not intended that such embodiments be regarded as limiting the scope of the disclosure, except as and to the extent that they are included in the following claims—that is, the foregoing description is merely illustrative, and it should be understood that variations and modifications can be effected without departing from the scope or spirit of the various embodiments as set forth in the following claims. Moreover, any document(s) mentioned herein are incorporated by reference in its/their entirety, as are any other documents that are referenced within such document(s).

I claim:

1. A refrigerated display merchandiser having a vertical axis, the refrigerated display merchandiser comprising:

a display zone defining a product display region;

an air circulation zone including at least one air circulation device; and a microchannel evaporator disposed within the air circulation zone, the microchannel evaporator comprising a plurality of substantially parallel flat tubes and a plurality of fins between at least some of the plurality of tubes, wherein the microchannel evaporator is offset from a horizontal axis of the refrigerated display merchandiser by an angle of up to 30 degrees with the plurality of tubes and the plurality of fins being at least substantially vertically oriented with respect to the vertical axis of the refrigerated display merchandiser.

2. The refrigerated display merchandiser of claim 1, wherein the refrigerated display merchandiser is an open front type refrigerated display merchandiser.

3. The refrigerated display merchandiser of claim 1, wherein the microchannel evaporator includes a refrigerant inlet adapted to supply refrigerant of a predetermined temperature to the microchannel evaporator.

4. The refrigerated display merchandiser of claim 3, wherein the refrigerant inlet has a length less than about two feet.

5. The refrigerated display merchandiser of claim 4, wherein the refrigerant inlet has a length in the range of about 10 inches to about 18 inches.

6. The refrigerated display merchandiser of claim 3, wherein the predetermined temperature of the refrigerant is in the range of 15° F. to about 30° F.

7. The refrigerated display merchandiser of claim 3, wherein the predetermined temperature of the refrigerant is in the range of −5° F. to about −40° F.

8. The refrigerated display merchandiser of claim 3, wherein the predetermined temperature of the refrigerant is above about 30° F.

9. The refrigerated display merchandiser of claim 1, wherein the microchannel evaporator is offset from the horizontal axis of the refrigerated display merchandiser by an angle in the range of about 0° to about 15°.

10. The refrigerated display merchandiser of claim 1, wherein a predetermined quantity of air is supplied to and cooled by the microchannel evaporator, and wherein at least a portion of the cooled air is supplied to the display zone via the air circulation zone.

11. The refrigerated display merchandiser of claim 1, wherein the microchannel evaporator cools air, and wherein at least a portion of the cooled air is supplied to the display zone via at least one opening defined between the display zone and the air circulation zone.

12. The refrigerated display merchandiser of claim 1, wherein a predetermined quantity of air is supplied to and cooled by the microchannel evaporator, wherein the predetermined quantity of air is supplied to the microchannel evaporator at least substantially in the direction of gravity.

13. The refrigerated display merchandiser of claim 1, wherein the microchannel evaporator has a fin density is in the range of 2 fins per inch and 14 fins per inch.

14. The refrigerated display merchandiser of claim 1, wherein each of the plurality of tubes has a depth in the range of about 0.5 inch to about 2.5 inches and a spacing in the range of about 0.3 inch to about 0.8 inch.

15. A refrigerated display merchandiser having a vertical axis, the refrigerated display merchandiser comprising:

a rear wall substantially parallel to the vertical axis, the rear wall having a top edge and a bottom edge;

a top wall extending from the top edge of the rear wall and being normal to the vertical axis;

a base extending from the bottom edge of the rear wall and being normal to the vertical axis a back panel horizontally offset from the rear wall and having a top edge and a bottom edge;

a top panel extending from the top edge of the back panel and being vertically offset from the top wall;

an interior base panel extending from the bottom edge of the back panel and being vertically offset from the base;

a display zone defined between the top panel and the interior base panel and forward of the back panel, the display zone including a product display region;

an air circulation zone including at least one air circulation device, the air circulation zone being substantially continuous and being defined between the top wall and the top panel, between the rear wall and the back panel, and between the base and the interior base panel; and a microchannel evaporator disposed within the air circulation zone, the microchannel evaporator comprising a plurality of substantially parallel flat tubes and a plurality of fins between at least some of the plurality of tubes, wherein the microchannel evaporator is offset from a horizontal axis of the refrigerated display merchandiser by an angle of up to 30 degrees with the plurality of tubes and the plurality of fins being at least substantially vertically oriented with respect to the vertical axis of the refrigerated display merchandiser.

16. The refrigerated display merchandiser of claim 15, wherein the refrigerated display merchandiser is an open front type refrigerated display merchandiser.

17. The refrigerated display merchandiser of claim 15, wherein the microchannel evaporator includes a refrigerant inlet adapted to supply refrigerant of a predetermined temperature to the microchannel evaporator.

18. The refrigerated display merchandiser of claim 17, wherein the refrigerant inlet has a length less than about two feet.

19. The refrigerated display merchandiser of claim 18, wherein the refrigerant inlet has a length in the range of about 12 inches to about 18 inches.

20. The refrigerated display merchandiser of claim 17, wherein the predetermined temperature of the refrigerant is in the range of 15° F. to about 30° F.

21. The refrigerated display merchandiser of claim 17, wherein the predetermined temperature of the refrigerant is in the range of −5° F. to about −40° F.

22. The refrigerated display merchandiser of claim 17, wherein the predetermined temperature of the refrigerant is above about 30° F.

23. The refrigerated display merchandiser of claim 1, wherein the microchannel evaporator is offset from the horizontal axis of the refrigerated display merchandiser by an angle in the range of about 0° to about 15°.

24. The refrigerated display merchandiser of claim 15, wherein the microchannel evaporator cools air, and wherein at least a portion of the cooled air is supplied to the display zone via at least one opening defined between the display zone and the air circulation zone.

25. The refrigerated display merchandiser of claim 15, wherein the microchannel evaporator has a fin density is in the range of 2 fins per inch and 14 fins per inch.

26. The refrigerated display merchandiser of claim 15, wherein each of the plurality of tubes has a depth in the range of about 0.5 inch to about 2.5 inches and a spacing in the range of about 0.3 inch to about 0.8 inch.

* * * * *